United States Patent [19]

Spear et al.

[11] Patent Number: 4,605,453

[45] Date of Patent: Aug. 12, 1986

[54] FIRING CAP COMPOSITION CONTAINING LEAD STYPHNATE

[75] Inventors: Robert J. Spear, Flemington; Lance D. Redman, Macedon, both of Australia

[73] Assignee: The Commonwealth of Australia, Australia

[21] Appl. No.: 782,696

[22] Filed: Oct. 1, 1985

[51] Int. Cl.[4] ..... C06B 41/02

[52] U.S. Cl. ..... 149/24; 149/110; 149/111; 149/114; 102/204

[58] Field of Search ..... 149/24, 110, 111, 114; 102/204

[56] References Cited

U.S. PATENT DOCUMENTS 3,320,104 5/1967 Stadler et al. ..... 149/24

3,321,343 5/1967 Staba ..... 149/24

*Primary Examiner*—Stephen J. Lechert, Jr.

*Attorney, Agent, or Firm*—Stevens, Davis, Miller & Mosher

[57] ABSTRACT

A conducting composition suitable for use in a firing cap is disclosed. The conducting composition comprises normal lead styphnate which has a mean particle size not less than 55 microns, in admixture with carbon black which has a mean aggregate size between 5 microns and about 15 microns. The conducting composition has less sensitivity than known conducting compositions and therefore when used in a conducting cap renders the cap less likely to unintential ignition by induced e.m.f. such as from radio transmitters or the like.

11 Claims, 2 Drawing Figures

FIRING CAP COMPOSITION CONTAINING LEAD STYPHNATE

This invention relates to explosive compositions. The invention relates more particularly to conducting compositions suitable for use in caps for ammunition.

Electrical initiation is a common method for ignition of propellant and explosive trains. In conducting composition devices, an explosive composition which is made conductive by admixture of a suitable ingredient, usually graphite, is pressed between two electrodes. Passage of current through the composition above a threshold level generates sufficient heat to ignite the explosive.

One major application for conducting composition devices is in cartridge case primers (CC caps) for high rate of fire small calibre munitions. However, these conducting caps are subject to high sensitivity and can be accidentally initiated by electro magnetic energy coupling into the firing system. Such energy can be picked up from RF transmitters such as radar, telecommunication, navigation and survey equipment and represents a particular hazard at airfields and on board ships. The obtaining of a satisfactory low sensitivity cap is quite difficult because previous attempt to reduce the sensitivity have resulted in impairment of the reliable functioning of the cap.

It is an object of the present invention to provide an improved conducting composition of lower sensitivity.

In a general aspect the invention provides a conducting composition for a firing cap, said composition comprising a mixture of normal lead styphnate and carbon black.

Normal lead styphnate, which is the lead salt of trinitroresorcinal, is a well known initiating explosive. Conducting compositions containing lead styphnate and graphite are known in the art, but are subject to the drawbacks mentioned above. We have found that compositions of normal lead styphnate and carbon black as described in more detail below are unexpectedly superior to the compositions of the prior art.

The invention accordingly provides a conducting composition suitable for use in a firing cap, comprising normal lead styphnate which has a mean particle size not less than 55 microns, in admixture with carbon black which has a mean aggregate size between about 5 microns and about 15 microns.

The means particle size of the normal lead styphnate is preferably greater than 80 microns.

The composition preferably comprises by weight from about 85% to about 98% normal led styphnate and from about 15% to about 2% carbon black; more preferably from about 95% to about 97% normal lead styphnate and from about 5% to about 3% carbon black. A particularly preferred composition comprises about 96% normal lead styphnate and about 4% of carbon black.

Oil furnace black is the preferred carbon black to use in the present invention. The products sold by Australian Carbon Black as TINTACARB 90 and TINTACARB 140 have been found suitable, as will be apparent from the examples below.

In accordance with a further broad aspect of the present invention there is provided a conducting composition firing cap for use with ammunition comprising a firing cap casing defining a chamber for a conducting composition filling, a conducting composition filling in said chamber, said casing defining contact surfaces where a potential can be applied across the conducting composition filling, said conducting composition filling comprising a mixture of a normal lead styphnate and a carbon black as described above.

In order that the invention can be more clearly ascertained preferred embodiments will now be described with reference to the accompanying drawings wherein.

Both of the above caps can be filled with the conducting composition in accordance with the present invention and thereby result in a lower sensitivity conducting cap.

Figure 1:
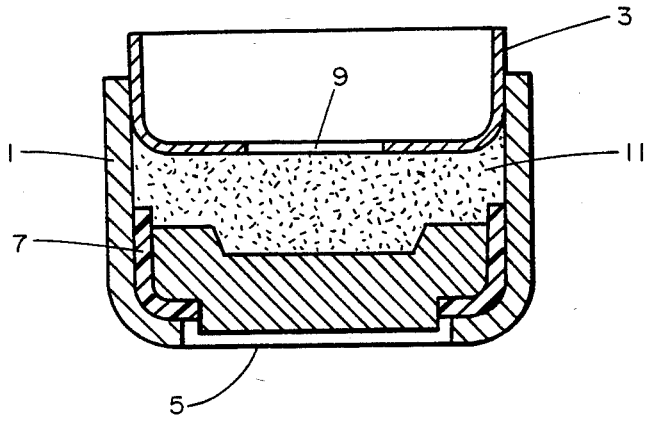
FIG. 1 shows a known prior art cap M52A3B1.

Referring firstly to FIG. 1 there is shown a cap with a metal external cup 1 which is closed at one end by a metal internal cup 3; the other end of the cup 1 is closed by a somewhat stepped shaped disk like centre contact 5. A cylindrical insulator 7 is situated between the external cup 1 and the centre contact 5. The internal cup 3 has a central conducting disk 9. A prior art conducting composition 11 is packed between the internal cup 3 and the centre contact 5. In use, a potential is applied across the internal cup 3 at disk 9 and to the centre contact 5. The conducting composition then ignites.

Figure 2:
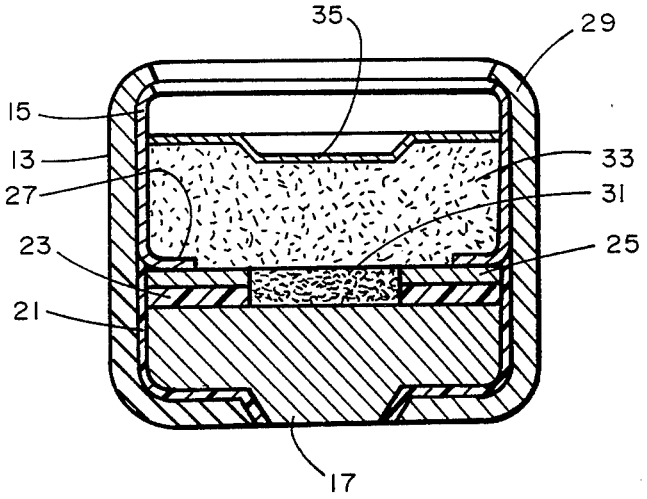
FIG. 2 shows a known prior art cap M52 DEFA.

Referring now to the embodiment shown in FIG. 2 it can be seen that it comprises an external cup 13 which has an internal cup 15 fitted therein. A centre contact 7 is provided at one end of the external cup 13. The centre contact 17 is disk like with a generally downwardly protruding centre contact extension 19. A generally cup-shaped insulator 21 isolate the centre contact 17 from the external cup 13. An inner most surface of the centre contact 17 and an annular contact washer 25 of electrically conducting metal is placed above the insulating washer 23. The internal cup 15 has radially inwardly directed ends 27 which make contact with the contact washer 25. The internal cup 15 is held within the external cup 13 by a rolled-over end 29 on the external cup 13. This, in turn, causes the internal cup to make good electrical contact with the contact washer 25. A prior art conducting composition 31 is placed within the central opening of the annular contact washer 25 and the insulating washer 23. A prior art priming charge 23 is placed in the internal cup 15 so as to be in direct contact with the contact washer 25 and the conducting composition 31. A saucer shaped foil membrane 35 is fitted behind the priming charge 33 within the internal cup 15. In use, a potential is applied across the external cup 13 and the centre contact 17 and this potential is, in turn, applied to the conducting composition 31 which causes it to ignite and to, in turn, initiate the priming charge 33.

Table 1 shows a comparison of the two prior art caps filled with prior art conducting compositions.

In the preferred embodiments of the invention the priming cap of FIG. 2 was filled with a conducting composition 11 made from normal lead styphnate type RD1303 of average particle size 115 microns, with Tintacarb 140 (manufactured by Australian Carbon Black) passed through a 106 micron sieve prior to use. A comparison was then made with a re-manufactured prior art cap of FIG. 2 where the ingredients were carefully proportioned. The Merck synthetic graphite was used as received. Barium nitrate, potassium perchlorate and calcium silicide were all commercial materials which were passed through a 75 micron sieve. Gum arabic and styphnic acid were commercial material used as received.

Table 2 shows a comparison of the M52 DEFA cap of FIG. 2 filled with different proportions of RD1303—Tintacarb 140 and against the prior art RD1303—Merck graphite cap. It can be seen that the RD1303—Tintacarb 140 provides a much lower sensitivity cap and is more stable over an extended period of time. The mixers for the M52 DEFA caps were made by weighing the ingredients in required amounts to give a total mass of two grams. Each two gram batch was then fold mixed on paper till visually homogeneous. The large batches of RD1303 with either Tintacarb 140 or Merck graphite consisted of 12 grams total, which are prepared in six 2 gram batches, as above, then combined and further mixed to ensure uniformity.

For the M52 DEFA caps the primers were made in two types.

1. The primer was prepared specifically for determination of energy sensitivity, power sensitivity and stability on thermal cycling.

These were produced by adding 46±0.5 mg of the conducting mix to the cap and pressing it at 123.5 MPa (400 kg dead load). In addition a small number of primers were prepared to investigate the effective pressing load. Each off the RD1303/Tentacarb 140 and Merck graphite compositions was used to produce 20 primers prepared as above except that the pressing load was 190.5 MPa (600 kg dead load), and a further twenty each at 82 MPa (245 kg dead load).

2. Primers prepared to access functioning times and their reproducibility so that a direct comparison with results for the M52 DEFA and the conventional M52A3B1 primers could be made.

The RD1303/Tintacarb 140 or Merck graphite primers were prepared by pressing in the conducting mix (46±0.5 mg) at 123.5 MPa followed by DEFA priming mix (145±1 mg, prepared as in Table 1) at the same pressing load. Primers based on M52A3B1 type mixes were prepared by adding the appropriate mix (175±1 mg) to the empty primer and pressing twice at 123.5 MPa.

The energy sensitivity, the power sensitivity, and functioning time and resistance were all measured by the same techniques. It can be seen from FIG. 2 that the sensitivity of the RD1303/Tintacarb 140 mixes in the various ratios of 95% to 5% by weight, 96%/4% by weight, 97%/3% by weight all exhibit considerably lower sensitivity that the RD1303/Merck 95%/5% mixes.

Unexpectedly the stability over a period of time is greatly enhanced over that of the RD1303/Merck mixes. It can be seen that the 96%/4% RD1303/Tintacarb 140 exhibits a generally preferred range.

Table 3 shows the effect of pressing the caps at various pressures where it can be seen that the RD1303/Tintacarb 140 mix is superior.

Table 4 shows a comparison of the conducting composition, primer composition in relation to known M52 DEFA and M52A3B1 primers. Table shows a performance data for M52 DEFA and M52A3B1 type primers.

TABLE 1

A comparison of the M52 DEFA and M52A3B1 Primers

| Component/Parameter | M52 DEFA Conducting Increment | M52 DEFA Priming Increment | M52A3B1 |
|---|---|---|---|
| Lead styphnate (%) | 95.0–95.5 | 48 | 40 ± 2.5 |
| Graphite (%) | 4.5–5.0 | 2 | |
| Acetylene black (%) | | | 0.75 ± 0.025 |
| Barium nitrate (%) | | 12 | 44.25 ± 2.5 |
| Potassium perchlorate (%) | | 28 | |
| Calcium silicide (%) | | 10 | 13.0 ± 2.5 |
| Gum arabic/ styphnic acid (%) | | | 1.0 ± 0.25 ea |
| Total mass (mg) | 30 | 160 | 170 |
| Resistance specification (Ω) | 20–500 | | 1k–1.2 M |
| Energy Sensitivity (μJ) | | | |
| 50% level | 60–120 | | 38–56 |
| 0.1%, 95% conf. level | ~12 | | ~3 |

TABLE 2

Test data for Large Scale batches of Experimental CC Primers based on Led styphnate RD1303 and Tintacarb 140 Merck Graphite Fillings

| Test | Composition: RD1303-Tintacarb 140 95:5 | RD1303-Tintacarb 140 96:4 | RD1303-Tintacarb 140 97:3 | RD1303-Merck 95:5 |
|---|---|---|---|---|
| Characterization | | | | |
| Energy Sensitivity (μJ) | | | | |
| 50% level | 1570 | 1330 | 740 | 2290 |
| 0.1%, 95% conf. level | 435 | 290 | 245 | 365 |
| Power Sensitivity (W) | | | | |
| 50% level | 2.10 | 2.38 | 2.03 | 0.63 |
| Functioning Time (ms) | 0.059 | 0.049 | 0.048 | 0.066 |
| (std. dev.) | (0.005) | (0.004) | (0.006) | (0.003) |
| Diurnal Cycling | | | | |
| Primer resistance (Ω) (std. dev.) | | | | |
| When pressed | 8.0 (0.6) | 12.9 (0.9) | 24.3 (2.4) | 7.1 (1.8) |
| 1 month | 10.9 (0.9) | 15.7 (1.0) | 27.6 (3.0) | 41.7 (18.1) |
| 3 months | 10.9 (1.1) | 15.7 (1.2) | 30.5 (3.2) | 55.0 (25.4) |

TABLE 2-continued

Test data for Large Scale batches of Experimental CC Primers based on Led styphnate RD1303 and Tintacarb 140 Merck Graphite Fillings

| | Composition | | | |
|---|---|---|---|---|
| | RD1303-Tintacarb 140 | | | RD1303-Merck |
| Test | 95:5 | 96:4 | 97:3 | 95:5 |
| 6 months | 13.7 (1.3) | 18.3 (1.4) | 32.9 (3.6) | 67.9 (30.8) |
| Energy Sensitivity (μJ) | | | | |
| 50% level | | | | |
| After 1 month | 1760 | 1245 | 830 | 2260 |
| 3 months | 1760 | 1125 | 740 | 1800 |
| 6 months | 1890 | 1335 | 880 | 2390 |

TABLE 3

Characterization of Experimental CC Primers Pressed at High (190.5 MPa) and Low (82 MPa) Pressing Loads

| | Composition | | | |
|---|---|---|---|---|
| | RD1303-Tintacarb 140 | | | RD1303-Merck |
| Test | 95:5 | 96:4 | 97:3 | 95:5 |
| Caps pressed at 190.5 MPa | | | | |
| Resistance (Ω) | | | | |
| When Pressed (std. dev.) | 5.8 (0.5) | 9.4 (0.5) | 19.1 (2.2) | 5.0 (0.9) |
| After 1 week (std. dev.) | 6.5 (0.6) | 10.4 (0.6) | 21.8 (3.4) | 38.9 (21.8) |
| Energy Sensitivity (μJ) | | | | |
| 50% level | 2180 | 1560 | 880 | 1760 |
| Functioning time (ms) (std. dev.) | 0.115 (0.031) | 0.118 (0.045) | 0.095 (0.061) | 0.138 (0.034) |
| Caps pressed at 82 MPa | | | | |
| Resistance (Ω) | | | | |
| When pressed (std. dev.) | 10.2 (0.9) | 18.8 (1.1) | 36.4 (4.9) | 11.9 (2.0) |
| After 1 week (std. dev.) | 11.1 (1.0) | 20.3 (1.2) | 39.7 (7.3) | 44.7 (20.8) |
| Energy Sensitivity (μJ) | | | | |
| 50% level | 2180 | 1150 | 660 | 1440 |
| Functioning time (ms) (std. dev.) | 0.113 (0.022) | 0.096 (0.008) | 0.103 (0.039) | 0.108 (0.031) |
| Caps pressed at 123.5 MPa | | | | |
| Functioning time (ms) (std. dev.) | 0.098 (0.020) | 0.078 (0.020) | 0.098 (0.067) | 0.108 (0.031) |

TABLE 4

A comparison of the preferred MRL CC Primer Composition with M52 DEFA and M52A3B1 Primers

| Parameter | RD1303-Tintacarb 140 (96:4) | M52 DEFA | M52A3B1 |
|---|---|---|---|
| Resistance (Ω) | | | |
| Measured [std. dev.] | 15.7 [1.2] (after 3 mths thermal cycling) | 99.1 [32.7] | 123.9k [100.1k] |
| Specification | | 20–500 | 1k–1.2 M |
| Energy Sensitivity (μJ) | | | |
| 50% level | 1330 | 68.2 | 64.3 |
| 0.1%, 95% conf. level | 290 | 5.0 | 4.9 |
| Power Sensitivity (W) | | | |
| 50% level | 2.38 | 0.3–0.5 | ~0.25 |
| Functioning time (ms) [std. dev.] | 0.049 [0.004] | 0.043 [0.005] | 0.081 [0.011] |

TABLE 5

Performance date for M52 DEFA and M52A3B1 Type Primers

| Composition | Resistance [Std. Dev.] (Ω) | Energy Sensitivity (μJ) | Functioning Times [Std. Dev.] (ms) |
|---|---|---|---|
| M52A3B1 Primer (Type)/Tintacarb 140 | | | |
| 95:5 | 16.4 [4.1] | 1445 | 0.301 [0.036] |
| 97:3 | 73.5 [15.1] | 650 | 0.187 [0.053] |
| 98:2 | 550.6 [162.3] | 280 | 0.154 [0.038] |
| 99:1 | 449k [571k] | 210 | 0.091 [0.024] |

TABLE 5-continued

Performance date for M52 DEFA and M52A3B1 Type Primers

| Composition | Resistance [Std. Dev.] (Ω) | Energy Sensitivity (μJ) | Functioning Times [Std. Dev.] (ms) |
|---|---|---|---|
| 99:25:0.75 | 9/20 11.4 M<br>11/20 > 20 M | 160 | 0.108 [0.035] |
| RD1303/Tintacarb 140 | | | |
| 95:5 | 9.1 [0.7] | 1565 | 0.059 [0.005] |
| 96:4 | 14.0 [1.0] | 1330 | 0.049 [0.004] |
| 97:3 | 24.3 [2.4] | 740 | 0.048 [0.006] |
| 98:2 | 82.0 [6.6] | 215 | 0.061 [0.012] |
| 99:1 | 2567 [460] | 130 | 0.061 [0.008] |
| Composite Primer: | | | |
| RD1303/Tintacarb 140 (96:4) (46.5 mg) then M52A3B1/Tintacarb 140 (98:2) (145 mg) | 19.3 [2.5] | not determined | 0.058 [0.006] |
| M52 DEFA Primer mix | 20/20 > 20 M | 580 | 0.052 [0.021] |

We claim:

1. A conducting composition suitable for use in a firing cap, comprising normal lead styphnate which has a mean particle size not less than 55 microns, in admixture with carbon black which has a mean aggregate size between 5 microns and about 15 microns.

2. A composition according to claim 1, in which the carbon black is an oil furnace black.

3. A composition according to claim 1, in which the normal lead styphnate has a mean particle size in excess of 80 microns.

4. A composition according to claim 1 comprising from about 85% to about 98% normal lead styphnate and from about 15% to about 2% carbon black.

5. A composition according to claim 1 comprising from about 95% to about 97% normal lead styphnate and from about 5% to about 3% carbon black.

6. A composition according to claim 1 comprising about 96% normal lead styphnate and about 4% carbon black.

7. A conducting composition suitable for use in a firing cap, comprising from about 85% to about 98% normal lead styphnate which has a mean particle size in excess of 80 microns, in admixture with from about 15% to about 2% of carbon black which has a mean aggregate size between about 5 microns and about 15 microns.

8. A composition according to claim 7, in which the carbon black is an oil furnace black.

9. A composition according to claim 7 or claim 8, comprising from about 95% to 97% normal lead styphnate and from about 5% to about 3% carbon black.

10. A composition according to claim 9, comprising about 96% normal lead styphnate and about 4% carbon black.

11. A conducting composition firing cap for use with ammunition comprising a firing cap casing defining a chamber for a conducting composition filling, a conducting composition filling in said chamber, said casing defining contact surfaces where a potential can be applied across the conducting composition filling, said conducting composition filling comprising a mixture of a normal lead styphnate and carbon black as defined in claim 1.

* * * * *